United States Patent [19]

Mitsuyama et al.

[11] Patent Number: 4,491,407

[45] Date of Patent: Jan. 1, 1985

[54] TONER IMAGE TRANSFER SYSTEM

[75] Inventors: Akira Mitsuyama; Yoshiaki Imanaka, both of Nara, Japan

[73] Assignee: Sharp Kabushiki Kaisha, Osaka, Japan

[21] Appl. No.: 382,123

[22] Filed: May 26, 1982

[30] Foreign Application Priority Data

May 29, 1981 [JP] Japan ..... 56-82745

[51] Int. Cl.[3] ..... G03G 15/16

[52] U.S. Cl. ..... 355/3 TR

[58] Field of Search ..... 355/3 TR, 3 SH, 3 CH, 355/3 R, 3 TE, 14 TR, 14 CH, 14 SH; 361/212, 214; 430/126

[56] References Cited

U.S. PATENT DOCUMENTS 3,813,548 5/1974 Silverberg ..... 250/324
3,850,519 11/1974 Weikel, Jr. ..... 355/3 TR
4,077,709 3/1978 Borostyan et al. ..... 355/3 TR

OTHER PUBLICATIONS

*Xerox Disclosure Journal,* vol. 2, No. 1, Jan./Feb. 1977, Borostyan, "Transfer Charge Maintaining System".

*Primary Examiner*—John F. Gonzales
*Assistant Examiner*—J. Pendegrass
*Attorney, Agent, or Firm*—Birch, Stewart, Kolasch & Birch

[57] ABSTRACT

A metal paper guide is disposed near the transcription section for leading a copy paper into the transcription section. The metal paper guide is grounded in the normal operational mode at the normal humidity condition. When the copying machine is placed in a high humidity condition, the metal paper guide is isolated from the grounded terminal for preventing the leakage of charges supplied on the copy paper through the metal paper guide.

4 Claims, 4 Drawing Figures

TONER IMAGE TRANSFER SYSTEM

BACKGROUND AND SUMMARY OF THE INVENTION

The present invention relates to a toner image transcription transfer unit in an electrophotographic copying machine.

The present invention relates, more particularly, to a control system for stabilizing a transcription operation without regard to the ambient humidity.

Generally, in an electrophotographic copying machine, a toner image is formed on a photosensitive drum through the use of a uniform charging corona unit, an image exposure system and a developing unit. The thus formed toner image is transcribed or transferred onto a copy paper through the use of a transcription or transfer corona unit. The transcription corona unit functions to apply charges to the copy paper of the same polarity as the electrostatic image formed on the photosensitive drum and of the opposite polarity to the charges carried by the toner, thereby electrostatically attracting the toner attached to the photosensitive drum surface.

Therefore, it is required that sufficient charges are applied to the copy paper for ensuring a stable transcription operation.

The copy paper is normally stored in a copy paper cassette and supplied to the transcription unit through the use of a copy paper supplying system. The copy paper supplying system includes a paper guide disposed near the transcription corona unit. The paper guide is made of metal and the copy paper is transferred along the paper guide in a fashion that the copy paper contacts the paper guide.

In a high humidity condition, the resistance value of the copy paper is reduced so that the charges supplied from the transcription corona unit flow through the paper guide to the body of the electrophotographic copying machine. This leakage of the charges will deteriorate the transcribed toner image.

The present inventors have discovered that the above-mentioned leakage of charges is precluded when the paper guide is electrically isolated from the body of the electrophotographic copying machine. Thus, a clean copy is obtained even at the high humidity condition. However, if the paper guide is insulated in the normal humidity condition or in the low humidity condition, the charges are accumulated on the paper guide. The thus accumulated charges will cause a spark between the paper guide and the body of the electrophotographic copying machine. The spark creates noises which prevent the accurate operation of the electronically controlled copying machine.

Accordingly, an object of the present invention is to provide a toner image transcription system which ensures a clean copy without regard to the ambient humidity.

Another object of the present invention is to provide a switching system for selectively grounding a paper guide which is disposed near a transcription corona unit.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a switching system is connected to a paper guide which is disposed near the transcription corona unit. In the high humidity condition, the switching system is switched on to electrically isolate the paper guide from the body of the copying machine. In the normal humidity condition or the low humidity condition, the switching system is switched off to electrically connect the paper guide to the body of the copying machine.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
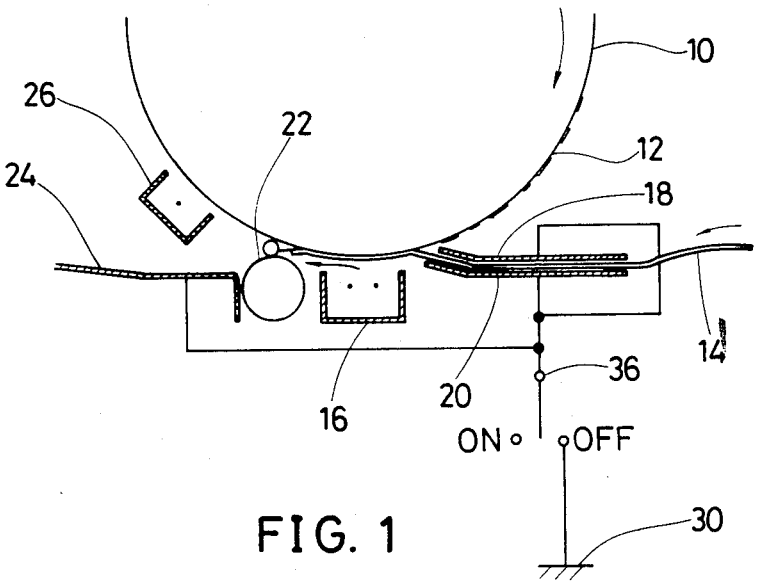
FIG. 1 is a schematic sectional view of an embodiment of a toner image transcription system of the present invention.

A photosensitive drum 10 is rotatably disposed in the electrophotographic copying machine. Around the photosensitive drum 10, a uniform charge corona unit (not shown), an image exposure system (not shown) and a developing unit (not shown) are disposed to form a toner image 12 on the photosensitive drum 10. A copy paper 14 is supplied from a copy paper cassette (not shown) to a transcription section by means of a copy paper feed mechanism. The transcription section includes a transcription corona charger unit 16 for supplying charges to the copy paper 14 having the polarity same as the electrostatic latent image formed on the photosensitive drum 10 and opposite to the toner attached to the electrostatic latent image. The copy paper 14 is guided to the transcription section through the use of a pair of paper guides 18 and 20. Thus, the toner image is transcribed from the photosensitive drum 10 to the copy paper 14. A copy paper separating unit 22 is disposed at the downstream of the transcription section for separating the copy paper 14 from the photosensitive drum 10. Another paper guide 24 is provided for leading the copy paper 14 toward a fixing section (not shown). An erase corona unit 26 is provided for erasing a residual image on the photosensitive drum 10. The paper guides 18, 20 and 24 are made of metal.

Figure 4:
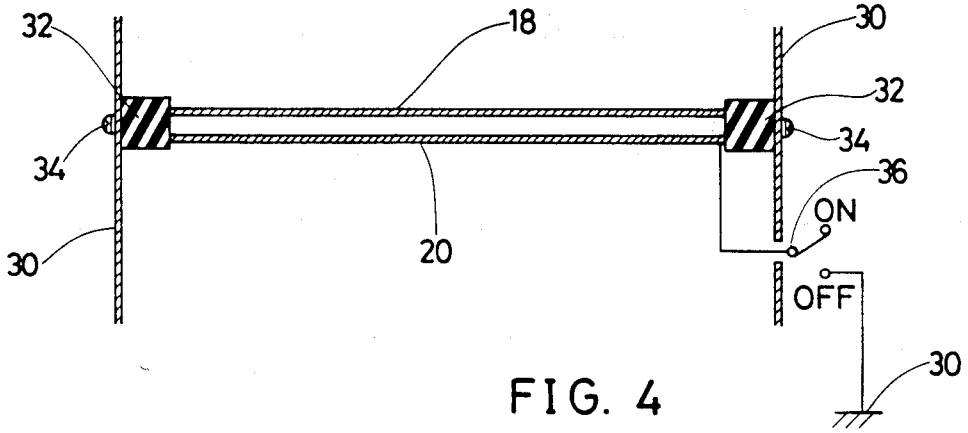
FIG. 4 is a sectional view of a paper guide supporting mechanism included in the toner image transcription system of the present invention.

The paper guides 18, 20 and 24 are supported by the body of the electrophotographic copying machine via an insulating resin member. FIG. 4 shows a condition where the paper guides 18 and 20 are supported by a body 30 of the electrophotographic copying machine. An insulating resin member 32 is secured to the body 30 through the use of a screw 34. The paper guides 18 and 20 are supported by the insulating resin member 32 so that the paper guides 18 and 20 are electrically isolated from the body 30 of the electrophotographic copying machine. The paper guide 24 is also electrically isolated from the body 30 of the electrophotographic copying machine. The paper guides 18, 20 and 24 are electrically connected to the body 30 via a switch 36 for grounding purposes.

When the switch 36 is placed in the ON state, the paper guides 18, 20 and 24 are electrically isolated from the body 30 of the electrophotographic copying machine. When the switch 36 is placed in the OFF state, the paper guides 18, 20 and 24 are grounded via the switch 36. The switch 36 can be a manual switch which is selectively operated by the operator. When the copying machine is placed in the high humidity condition, the switch 36 is switched on in order to electrically insulate the paper guides 18, 20 and 24. In the normal humidity condition or in the low humidity condition, the switch 36 is switched off in order to connect the paper guides 18, 20 and 24 to the grounded terminal.

Accordingly, in the high humidity condition, the switch 36 is switched on by the operator for electrically insulating the paper guides 18, 20 and 24 from the body 30 of the copying machine. The charges supplied from the transcription corona charger unit 16 to the copy paper 14 will not leak through the paper guides 18, 20 and 24 and, therefore, a clean copy is obtained. In the normal humidity condition or in the low humidity condition, the switch 36 is switched off in order to connect the paper guides 18, 20 and 24 to the grounded terminal. This grounded condition precludes the accumulation of the charges on the paper guides 18, 20 and 24.

Figure 2:
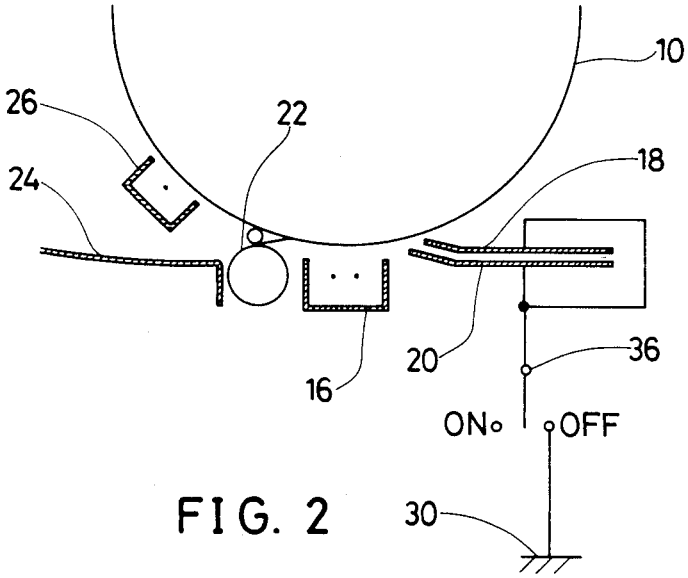
FIG. 2 is a schematic sectional view of another embodiment of a toner image transcription system of the present invention.

FIG. 2 shows another embodiment of the present invention, wherein the paper guides 18 and 20 are connected to the above-mentioned switch 36. However, the paper guide 24 is always connected to the body 30 of the electrophotographic copying machine. Like elements corresponding to those of FIG. 1 are indicated by like numerals. The embodiment of FIG. 2 shows a similar effect as the embodiment of FIG. 1.

Figure 3:
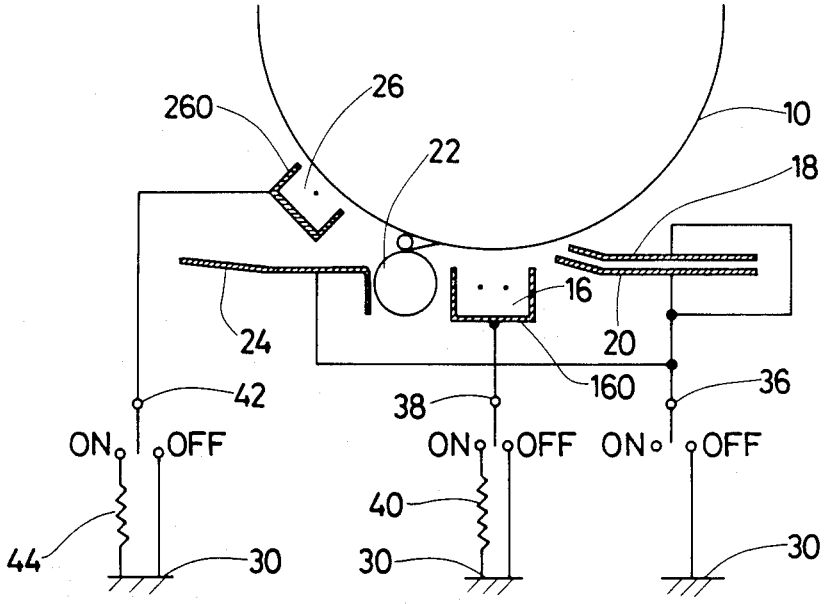
FIG. 3 is a schematic sectional view of still another embodiment of a toner image transcription system of the present invention.

FIG. 3 shows still another embodiment of the present invention. Like elements corresponding to those of FIG. 1 are indicated by like numerals.

The transcription corona charger unit 16 includes a shielding metal housing 160, and the erase corona unit 26 includes a shielding metal housing 260. The shielding metal housing 160 is connected to the body 30 of the electrophotographic copying machine, for grounding purposes, via a switch 38. More specifically, the OFF terminal of the switch 38 is grounded, and the ON terminal of the switch 38 is connected to the body 30 of the copying machine via a resistor 40 (about 1 MΩ). The shielding metal housing 260 is connected to the body 30 of the copying machine, for grounding purposes, via a switch 42. More specifically, the OFF terminal of the switch 42 is grounded, and the ON terminal of the switch 42 is connected to the body 30 of the copying machine via a resistor 44 (about 1 MΩ).

When the copying machine is placed in the high humidity condition, the switch 38 is placed in the ON state for interposing the resistor 40 between the shielding metal housing 160 and the body 30 (grounded) of the electrophotographic copying machine. Under these conditions, the discharge current is hard to flow toward the shielding metal housing 160 so that the charges applied to the copy paper 14 increase. Accordingly, the clean transcription is conducted even though the resistance value of the copy paper 14 is reduced. The resistor 40 can be omitted when the shielding metal housing 160 is insulated from the body 30 at a time when the switch 38 is placed in the ON state. However, it must be taken into account that the photosensitive drum 10 is exposed to the high intensity corona charging operation at a position where the copy paper 14 does not exist. If the switch 38 is placed in the ON state even at the normal humidity condition or at the low humidity condition, superfluous charges are applied to the copy paper 14. This will increase the attracting force between the copy paper 14 and the photosensitive drum 10. Therefore, the separating operation of the copy paper 14 from the photosensitive drum surface becomes difficult. Accordingly, it is required that, in the normal humidity condition or in the low humidity condition, the switch 38 is placed in the OFF state for grounding the shielding metal housing 160.

In order to minimize the above-mentioned deterioration of the photosensitive drum 10 caused by the high intensity corona charging of the transcription corona charger unit 16, it is preferable that the corona charging of the erase corona unit 26 is increased when the switch 38 is placed in the ON state. Accordingly, the switch 42 is correlated with the switch 38 so that the switch 42 is placed in the ON state when the switch 38 is placed in the ON state.

In a preferred form, the switches 36, 38 and 42 are correlated with each other so that the manual switching operation conducted to the switch 36 functions to switch the switches 36, 38 and 42. In another preferred form, a humidity sensor is disposed in the electrophotographic copying machine for automatically switching the switches 36, 38 and 42 in response to the detected humidity.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A toner image transfer system in an electrophotographic copying machine comprising:

a transfer corona charger unit disposed at a predetermined position around a photosensitive drum;

a copy paper feed mechanism for supplying a copy paper to a clearance formed between the photosensitive drum and the transfer corona charger unit, said copy paper feed mechanism including a paper guide for guiding copy paper to said clearance;

said paper guide being constructed of metal and secured to the body of the electrophotographic copying machine with the intervention of an insulating member; and a switching system for selectively grounding said paper guide or electrically isolating said paper guide from the body of said electrophotographic copying machine;

wherein said switching system includes manual switch means for enabling an operator to selectively control characteristics of copies produced by said machine wherein said manual switch means may be switched on in a high humidity condition in order to electrically isolate said paper guide from said body of the electrophotographic copying machine and may be switched off in a normal humidity condition or in a low humidity condition in order to connect said paper guide to a grounded terminal.

2. The toner image transfer system of claim 1, wherein said transfer corona charger unit includes a shielding metal housing, and which transfer system further comprises a second switching system for selectively grounding said shielding metal housing of said transfer corona charger unit or connecting said shielding metal housing to the grounded terminal via a resistor, wherein said second switching system is placed in a condition where said shielding metal housing is grounded when said manual switch means is switched off, and is placed in the other condition where said shielding metal housing is connected to the grounded terminal when said manual switch means is switched on.

3. The toner image transfer system of claim 2, which further includes an erase corona unit having a shielding metal housing and which transfer system further comprises a third switching system for selectively grounding said shielding metal housing of said corona erasing unit or connecting that shielding metal housing to the grounded terminal via a resistor, wherein said third switching system is placed in a condition where said shielding metal housing of said corona erasing unit is grounded when said manual switch means is switched off, and is placed in the other condition where said shielding metal housing of said corona erasing unit is connected to the grounded terminal when said manual switch means is switched on.

4. The toner image transfer system of claim 1, which further includes an erase corona unit having a shielding metal housing and which transfer system further comprises a switching system for selectively grounding said shielding metal housing of said corona erasing unit or connecting that shielding metal housing to the grounded terminal via a resistor, wherein said switching system is placed in a condition where said shielding metal housing of said corona erasing unit is grounded when said manual switch means is switched off, and is placed in the other condition where said shielding metal housing of said corona erasing unit is connected to the grounded terminal when said manual switch means is switched on.

* * * * *